United States Patent [19]

Eschenbach et al.

[11] Patent Number: 4,610,131

[45] Date of Patent: Sep. 9, 1986

[54] METHOD OF FORMING AIR TEXTURED BOUCLÉ YARN

[75] Inventors: Paul W. Eschenbach, Moore; André M. Goineau, Spartanburg, both of S.C.

[73] Assignee: Milliken Research Corporation, Spartanburg, S.C.

[21] Appl. No.: 816,507

[22] Filed: Jan. 6, 1986

Related U.S. Application Data

[60] Continuation of Ser. No. 689,168, Jan. 7, 1985, abandoned, which is a division of Ser. No. 662,573, Oct. 19, 1984.

[51] Int. Cl.[4] ..... D02G 1/16; D02G 1/20; D02G 3/34; D02G 3/38

[52] U.S. Cl. ..... 57/6; 57/208; 57/227; 57/289; 57/350; 57/908

[58] Field of Search ..... 57/5, 6, 206, 207, 208, 57/282, 284, 287–289, 290, 350, 351, 225, 226, 227, 228

[56] References Cited

U.S. PATENT DOCUMENTS

| | | | |
|---|---|---|---|
| 2,864,230 | 12/1958 | Moore, Jr. | 57/6 |
| 3,153,315 | 10/1964 | Arthur et al. | 57/207 |
| 3,200,576 | 8/1965 | Maeror et al. | 57/908 X |
| 3,296,785 | 1/1967 | Hardy, III | 57/350 |
| 3,410,076 | 11/1968 | Dyer | 57/207 |
| 3,447,302 | 6/1969 | Field | 57/6 |
| 3,474,613 | 10/1969 | Joarder | 57/208 |
| 3,477,220 | 11/1969 | Marshall | 57/6 X |
| 3,948,033 | 4/1976 | Hewstock et al. | 57/908 X |
| 4,051,660 | 10/1977 | Griset | 57/908 X |
| 4,058,968 | 11/1977 | Benson | 57/207 |
| 4,169,349 | 10/1979 | Talbot | 57/247 X |
| 4,212,152 | 7/1980 | Roman | 57/207 |
| 4,218,869 | 8/1980 | Newton | 57/289 X |
| 4,219,997 | 9/1980 | Hatcher | 57/289 X |
| 4,244,173 | 1/1981 | Lulay | 57/208 X |
| 4,304,092 | 12/1981 | Bridges et al. | 57/6 X |
| 4,311,000 | 1/1982 | London et al. | 57/6 |
| 4,330,988 | 5/1982 | Eschenbach | 57/6 |
| 4,345,424 | 8/1982 | Davis et al. | 57/206 X |
| 4,351,148 | 9/1982 | Eschenbach | 57/908 X |
| 4,365,466 | 12/1982 | Horiuchi et al. | 57/908 X |

*Primary Examiner*—Donald Watkins

*Attorney, Agent, or Firm*—Earle R. Marden; H. William Petry

[57] ABSTRACT

A bouclé yarn is produced by entangling a drawn core yarn and an air textured, drawn effect yarn. The air textured, drawn effect yarn provides a plurality of randomly spaced curls or loops around the core yarn to produce the bouclé yarn appearance. A number of the random curls or loops are embedded in the core yarn during the entangling process.

2 Claims, 4 Drawing Figures

METHOD OF FORMING AIR TEXTURED BOUCLé YARN

This is a continuation application under 37 C.F.R. 1.62 of U.S. application Ser. No. 689,168 filed on Jan. 7, 1985, now abandoned, which is a division U.S. application Ser. No. 662,573 filed 10-19-84.

This invention relates to a method to produce a bouclé yarn from two continuous filament, synthetic yarns. One yarn will be a core yarn and the other yarn will be the effect yarn which provides the curled or looped look to the yarn.

It is, therefore, an object of the invention to provide a method to produce a bouclé yarn from at least two continuous filament, synthetic yarns.

Other objects and advantages of the invention will become readily apparent as the specification proceeds to describe the invention, with reference to accompanying drawings, in which.

Figure 1:
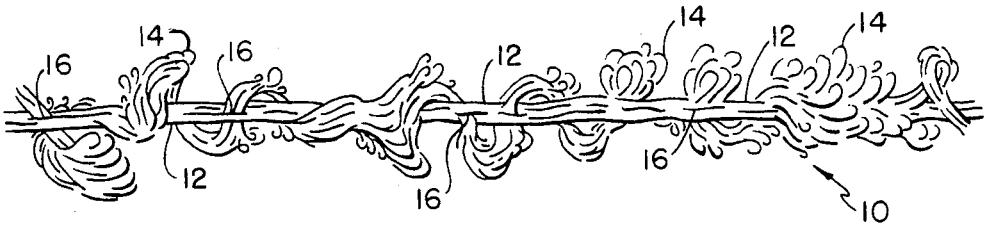
FIG. 1 is a drawing of the bouclé yarn made by the disclosed process.

By definition, a bouclé yarn is a popular novelty yarn which has a curled, looped, bunched or crimped effect interspersed throughout its length to provide a rough surface effect such as that shown in FIG. 1. The bouclé yarn 10 consists of the core yarn 12 and the looped, air textured effect yarn 14. As can be seen in FIG. 1, the effect yarn 14 is imbedded at spaced points 16, in the core yarn 12 to provide a secure interconnection between the core and effect yarns.

Figure 2:
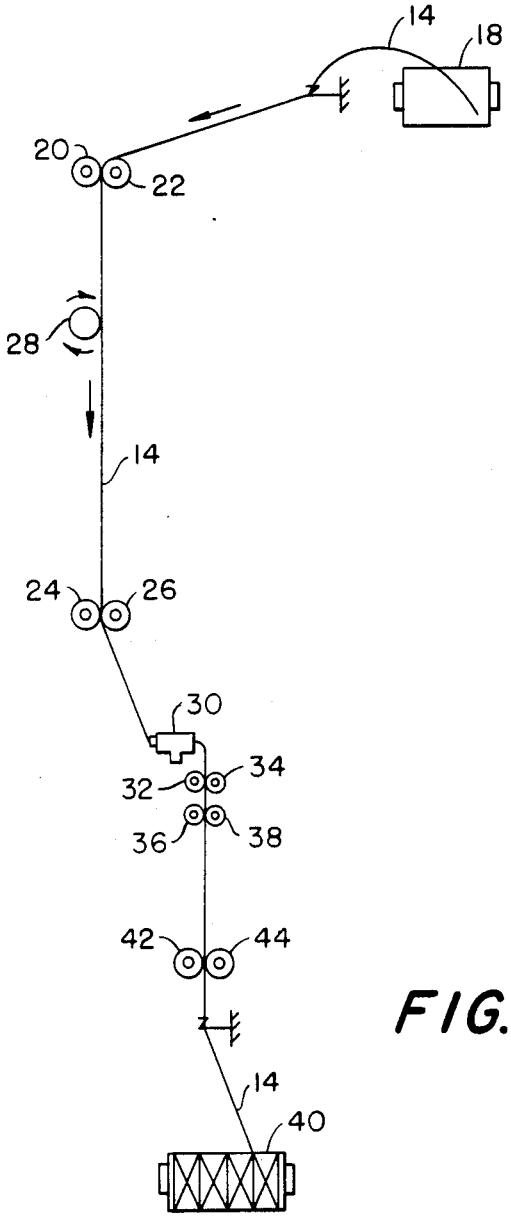
FIG. 2 is a schematic representation of the method to produce the effect yarn.
Figure 3:
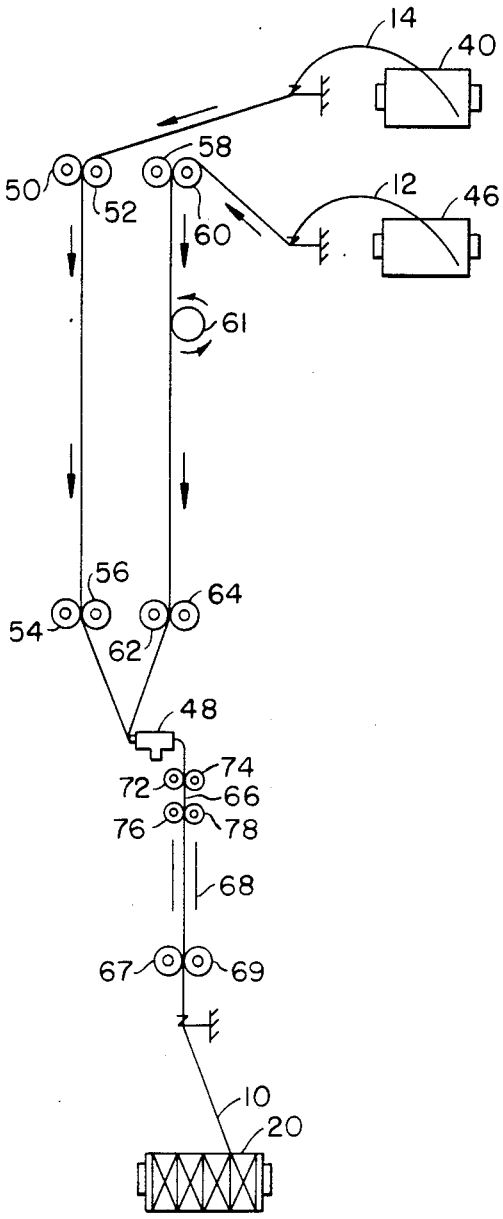
FIG. 3 is a schematic representation of the method to produce the bouclé yarn of FIG. 1.

FIGS. 2 and 3 indicate, schematically, the preferred method of producing the yarn 10 of FIG. 2. The yarn 10 in the method of FIGS. 2 and 3 is produced in a two-step process. The effect yarn 14 is initially air textured and taken up on a package as in FIG. 2 and then combined in an air texturing nozzle with the core yarn 12 as shown in FIG. 3 to form the bouclé yarn 10 of FIG. 1.

Looking first at FIG. 2 the continuous filament, partially oriented, 255 denier, 68 filament, DuPont 56T polyester effect yarn 14 is supplied from the package 18 to a pair of supply rolls 20 and 22 running at a speed of 251 meters/minute. The effect yarn 16 is drawn between the supply rolls 20 and 22 and the draw rolls 24 and 26 as it is drawn around the hot pin 28 (125° C.) by the draw rolls 24 and 26. The effect yarn 16 is textured in the air jet 30, operating at approximately 150 p.s.i., and delivered to the stabilizing zone represented by the nip rolls 32, 34 and 36, 38. Nip rolls 32, 34 are operating at a speed of 394 meters/minute and nip rolls 36, 38 at a speed of 400 meters/minute. The resultant 163 denier, 68 filament textured effect yarn is then delivered to take up on the take-up package 40 running at a speed of 392 meters/minute by the delivery rolls 42 and 44 running at a speed of 400 meters/minute.

Looking now to FIG. 3 the 163 denier, 68 filament textured effect yarn package 40 is shown in a position adjacent the core yarn package 46 containing continuous filament, 255 denier, 68 filament partially oriented DuPont 56T polyester yarn. The effect yarn 14 is delivered to the air texturing jet 48 in basically the same condition that it comes off the package 40 by nip rolls 50, 52 and nip rolls 54, 56 all running at substantially the same speed of 401 meters/minute. The partially oriented core yarn is delivered by the feed rolls 58, 60 running at a speed of 141 meters/minute to the air nozzle 48 and passes around the hot pin (125° C.) 61 and is drawn by the draw rolls 62, 64 prior to the entrance to the jet 48. The air texturing and entangling jet 48 can be any suitable, commercially available jet and is operated at a pressure of approximately 150 p.s.i. to produce the desired yarn effect. In conventional manner the textured and entangled yarn from the jet passes through the stabilization zone 66, the post heater 68 (235° C.), rolls 67, 69, and the take-up roll running at a speed of approximately 192 meters/minute whereupon the yarn 10 is delivered to the take-up package 70. To allow the commingled yarn from the jet 48 to stabilize the rolls 72, 74 run at a speed of 200 meters/minute and the rolls 76, 78 run at a speed of 194 meters/minute. The resulting commingled yarn has a nominal denier of 520.

Figure 4:
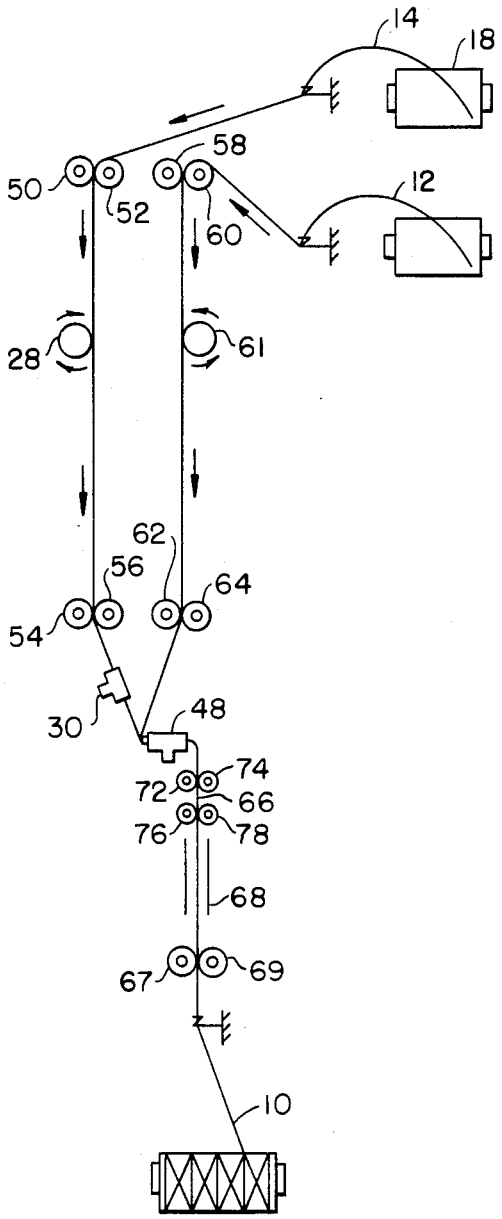
FIG. 4 is a modification of the method shown in FIGS. 2 and 3.

The modification of FIG. 4 also produces the novel bouclé yarn 10 shown in FIG. 1 and basically is a continuous process of that shown in FIGS. 2 and 3. In FIG. 4, the effect yarn 14 is delivered from the package 18 and is drawn and textured without being taken up on the package 40 prior to combining with the core yarn 12. In FIG. 4 like elements of FIGS. 2 and 3 have the same reference with the basic difference being that the speed of rolls 50, 52 is 236 meters/minute, the hot pin 28 is located between the roll sets 50, 52 and 54, 56, and the yarn texturing nozzle 30 is located after the rolls 54, 56 and prior to the entrance to the air texturing nozzle 48. As can be seen this form of the invention eliminates the step of taking up the textured effect yarn 14 on the package 40.

The herein disclosed method to produce a bouclé type yarn provides a simple and efficient system that requires very little modification to commercial yarn processing equipment to obtain the desired result. The bouclé type yarn produced has the looped covering effect yarn embedded in the core yarn to secure the yarns together and provides an unusual effect in the fabric produced therefrom due to the random spacing of the curls or loops on the exterior of the yarn. The embedding of the effect yarn in the core yarn tends to alleviate the strip back problem that exists in the use of wrapped yarns in the manufacturing process such as knitting or weaving.

Although the preferred embodiments of the invention have been described in detail it is contemplated that many changes may be made without departing from the scope of the invention and it is, therefore, desired that the invention be limited only by the claims.

I claim:

1. The method of producing a bouclé type yarn comprising the steps of: supplying a multifilament, partially oriented, synthetic effect yarn, drawing said effect yarn, air jet texturing said effect yarn after drawing of same, supplying a multifilament, untextured partially oriented synthetic core yarn, drawing said core yarn, entangling said drawn core yarn and said air textured effect yarn in an air texturing jet, allowing said entangled yarn to stabilize and taking up the entangled yarn.

2. The method of claim 1 wherein said effect yarn is drawn and textured in a continuous process with the drawing of the core yarn.

* * * * *